United States Patent [19]

Müller

[11] 4,080,678

[45] Mar. 28, 1978

[54] APPARATUS FOR ATTACHING SHEETS TO GROUPS OF LEAVES IN BOOKBINDING MACHINES

[75] Inventor: Hans Müller, Zofingen, Switzerland

[73] Assignee: Grapha-Holding AG, Hergiswil, Switzerland

[21] Appl. No.: 719,579

[22] Filed: Sep. 1, 1976

[30] Foreign Application Priority Data

Sep. 9, 1975 Switzerland ..... 11696/75

[51] Int. Cl.[2] ..... B42C 19/00

[52] U.S. Cl. ..... 11/1 AD; 11/4; 270/53; 271/271

[58] Field of Search ..... 11/1 AD, 1 R, 1 CP, 11/2, 4; 271/9, 271, 38, 233, 243; 270/53, 58, 931; 156/477 B

[56] References Cited

U.S. PATENT DOCUMENTS

| | | | |
|---|---|---|---|
| 2,422,996 | 6/1947 | Wendt | 11/4 |
| 2,962,733 | 12/1960 | Kramer et al. | 11/4 |

*Primary Examiner*—Stephen C. Pellegrino

*Attorney, Agent, or Firm*—Peter K. Kontler

[57] ABSTRACT

Cover lining sheets are attached to adhesive-coated edge faces of groups of leaves in a bookbinding machine while the groups are held and advanced by grippers along a first horizontal path. The sheets are fed in front of successive pushers which thereupon advance along a second horizontal path below the first path and alternate with the grippers. The speed of pushers is increased during a first stage of movement along the second path so that the pushers catch up with and thereupon move at the speed of the preceding grippers during transfer of sheets to the edge faces of the groups thereabove. The speed of the pushers is thereupon reduced to a speed which is less than the speed of the grippers. The grippers are attached to an endless chain and each pusher is attached to two endless chains. The drive for the two endless chains which carry the pushers has two units one of which can drive the two chains at a constant speed exceeding the speed of the grippers and the other of which can change the speed of the chains during the aforementioned stages of movement of pushers along the second path.

14 Claims, 4 Drawing Figures

APPARATUS FOR ATTACHING SHEETS TO GROUPS OF LEAVES IN BOOKBINDING MACHINES

BACKGROUND OF THE INVENTION

The present invention relates to bookbinding machines in general, and more particularly to improvements in apparatus for attaching end papers, cover lining sheets or other types of sheets to adhesive-coated edge faces of groups of leaves (e.g., groups of gathered signatures) in a bookbinding machine.

End papers, cover lining sheets or analogous components are attached to groups of gathered leaves while the groups are held by equally spaced grippers or tongs and move in the bookbinding machine along a straight portion of an endless path which is defined by a conveyor for the grippers. One edge face of each group is coated with a suitable adhesive, and each sheet must be properly oriented with respect to the corresponding group of leaves in order to insure that a predetermined portion of the sheet is bonded to the associated group. The machine normally further comprises devices which treat the groups of leaves during transport along or ahead of the aforementioned portion of the endless path; such devices may include a paster which applies a film of adhesive to a selected edge face of each group of leaves. As a rule, the machine further comprises means for urging properly oriented sheets against the films of adhesive at the edge faces of adjacent groups to insure that the sheets are properly bonded to such groups; the pressing means may but need not be heated, depending on the nature of the adhesive. The sheets are withdrawn from a magazine by a suitable feeding device.

In certain presently known bookbinding machines, the feeding device includes a suction head or analogous means for withdrawing discrete sheets from the magazine and an upwardly sloping conveyor which transports successive sheets along an inclined path onto a pressing member which is mounted at a level below the aforementioned straight portion of the path for the grippers and is movable in the direction of movement of the adjacent gripper, counter to such direction as well as up and down so that a sheet which rests on the pressing member is attached to the adjacent group while the pressing member moves upwardly. The pressing member includes means for centering the sheet thereon in order to insure that the sheet is properly oriented before it comes into contact with the film of adhesive on the respective group. The machine comprises a conveyor which moves the pressing member back and forth along a second path which is located at a level below and is parallel to the straight portion of the path for the grippers. The centering means is active during upward movement of the pressing member. Reference may be had to Swiss Pat. No. 475,098.

A drawback of the just described conventional apparatus is that the pressing member cannot be moved at a high speed because the orientation of sheets thereon takes place while the pressing member moves upwardly toward the adjacent gripper. Moreover, the pressing member must move back to a starting position before it receives a fresh sheet. Consequently, the output of the bookbinding machine is relatively low because the speed of grippers cannot exceed the speed of the pressing member. In the absence of such pressing member, the machine could turn out a much larger number of books, brochures, pamphlets or the like per unit of time.

SUMMARY OF THE INVENTION

An object of the invention is to provide a bookbinding machine wherein the application of cover lining sheets or the like to groups of leaves can be carried out at a speed which greatly exceeds the speed of application of such parts in presently known bookbinding machines.

Another object of the invention is to provide a high-speed bookbinding machine wherein a single pressing member suffices to insure proper bonding of successive cover lining sheets or the like to the adjacent groups of leaves.

A further object of the invention is to provide an apparatus which can be used in existing bookbinding machine for rapid and reproducible application of cover lining sheets or the like to successive groups of leaves while such groups move at an elevated speed which need not be reduced for the purpose of insuring proper attachment of sheets thereto.

An additional object of the invention is to provide novel and improved means for driving certain component parts of the above outlined bookbinding machine.

Still another object of the invention is to provide a bookbinding machine with novel and improved apparatus for feeding, centering, orienting, attaching and bonding cover lining or other types of sheets to groups of leaves or the like.

An ancillary object of the invention is to provide the apparatus with novel and improved means for transporting cover lining sheets or the like prior to and during attachment of such components to groups of leaves.

The invention is embodied in an apparatus which forms part of a bookbinding machine wherein sheets of paper or the like are attached to adhesive-coated edge faces of groups of leaves (such groups may comprise two or more signatures whose backs are coated with adhesive). The apparatus comprises a first conveyor having a plurality of equally spaced grippers or tongs for groups of leaves and means (e.g., one or more endless chains) for transporting the grippers, preferably at a constant first speed, along a first endless path having a preferably horizontal or nearly horizontal and preferably straight elongated portion along which the grippers move in a predetermined direction, a second conveyor having a plurality of equally spaced entraining elements or pushers and means (e.g., one or more endless chains) for transporting the pushers along a second endless path having a preferably horizontal and preferably straight elongated portion which is adjacent to and substantially parallel to the elongated portion of the first path (the elongated portion of the second path can be located at a level slightly below the elongated portion of the first path) and along which the pushers move in the aforementioned direction and alternate with the grippers so that each gripper (which carries a group of leaves during travel along the elongated portion of the first path) precedes a pusher in the elongated portion of the second path, a magazine or an analogous source of stacked sheets, means for feeding discrete sheets from the source in front of successive pushers which enter or are about to enter the elongated portion of the second path whereby the oncoming pushers entrain the respective sheets and advance such sheets along the elongated portion of the second path in substantial register with the edge faces of groups which are held by the preceding grippers, and drive means for the transporting means of the second conveyor. In accordance with a feature of the invention, the drive means includes a first unit having means (e.g., a transmission whose output element transmits torque to one or more sprocket wheels for the chain or chains of transporting means of the second conveyor) for moving the transporting means of the second conveyor at a substantially constant second speed which exceeds the speed of the grippers and a second unit having means (e.g., a cam and followerdrive) for changing the speed of the transporting means of the second conveyor during a plurality of predetermined stages of movement of pushers along the elongated portion of the second path to thereby effect proper orientation of sheets which are advanced by the pushers in register with groups in the preceding grippers. The apparatus further comprises means (preferably a single pressing member) for transferring sheets from the elongated portion of the second path into contact with the adhesive-coated edge faces of groups in the preceding grippers during a selected stage of movement of the respective pushers along the elongated portion of the second path.

The speed changing means of the second unit of the drive means is preferably constructed and assembled in such a way that the speed of the pushers increases above the second speed during at least one first stage of several stages of movement of pushers along the elongated portion of the second path and that the speed of the pushers decreases to a speed which is less than the speed of the grippers during at least one second stage of movement of pushers along the elongated portion of the second path. This enables the pushers to catch up with the preceding grippers and to abut against such grippers during transfer of sheets from the second path, and the grippers to move ahead of the next-following pushers subsequent to attachment of sheets to the adjacent groups of leaves.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
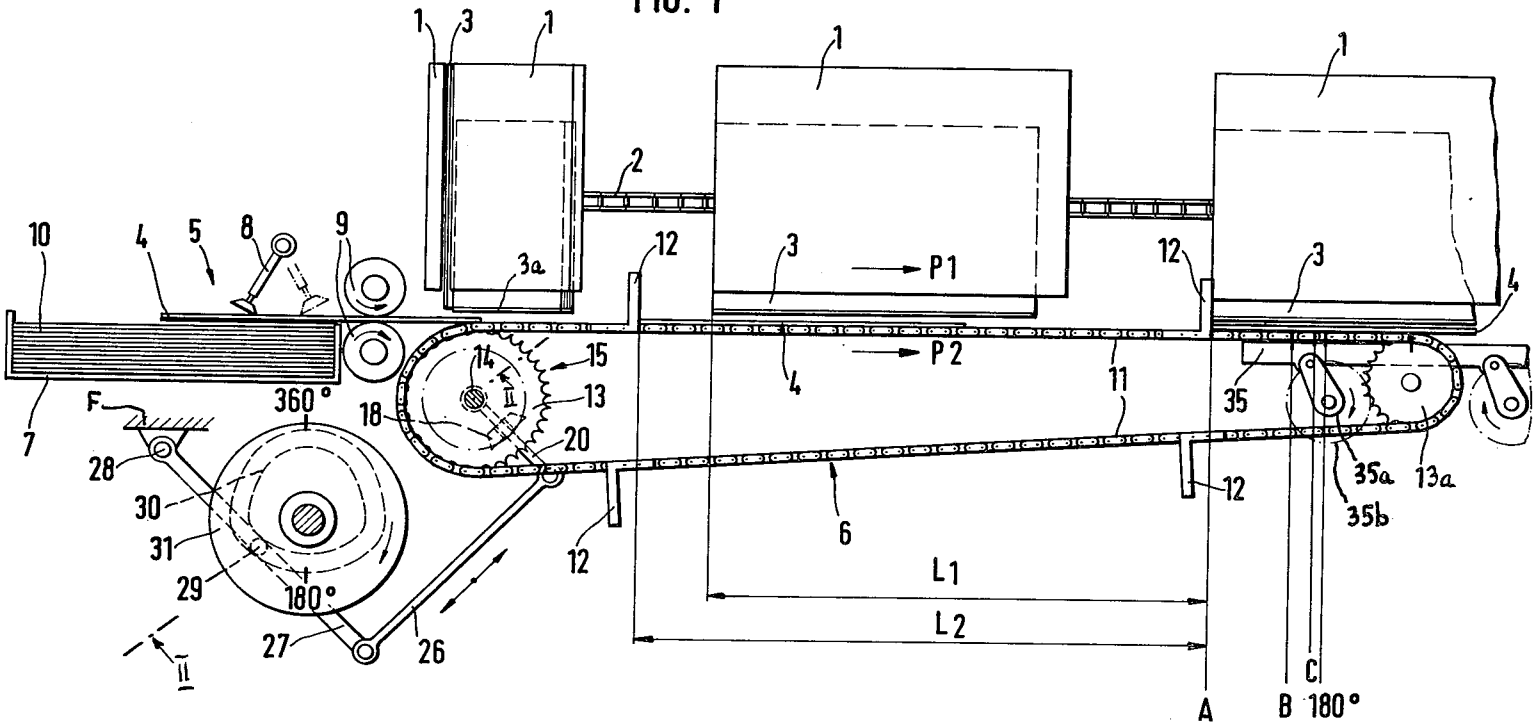
FIG. 1 is a fragmentary schematic side elevational view of a bookbinding machine including an apparatus which embodies the invention.

Referring to FIG. 1, there is shown a portion of a bookbinding machine having a first conveyor for groups or stacks 3 of leaves (each such group may include two or more signatures) which are held by suitable grippers 1 in a manner known from the art. The grippers 1 form part of the first conveyor which further includes at least one endless chain 2 or an analogous flexible transporting device. The grippers 1 are equally spaced from each other and are secured to the chain 2. The latter is trained over two spaced-apart sprocket wheels (not shown) so that it is located in a horizontal plane and has two elongated horizontal stretches (one shown in FIG. 1). When one of the sprocket wheels receives motion from the main prime mover (not shown) of the bookbinding machine, the grippers 1 travel along an endless path having an elongated straight horizontal portion wherein the grippers 1 move in the direction indicated by arrow P1. Each gripper which moves along the just mentioned straight horizontal portion carries a group 3 and the lower edge face 3*a* of such group is coated with a film of adhesive. The adhesive can be applied by a paster (not shown) which is adjacent to the rear stretch of the chain 2, i.e., behind the illustrated stretch. The manner in which the groups 3 are fed into the range of successive grippers 1 upstream of the paster and in which the grippers 1 are opened to allow for removal of groups 3 is known from the art and is not shown in the drawing. Alternatively, the edge face 3*a* of each group 3 which is fed to an oncoming gripper 1 can be provided with a film of adhesive, i.e., the paster need not be adjacent to the path of grippers 1.

Figure 2:
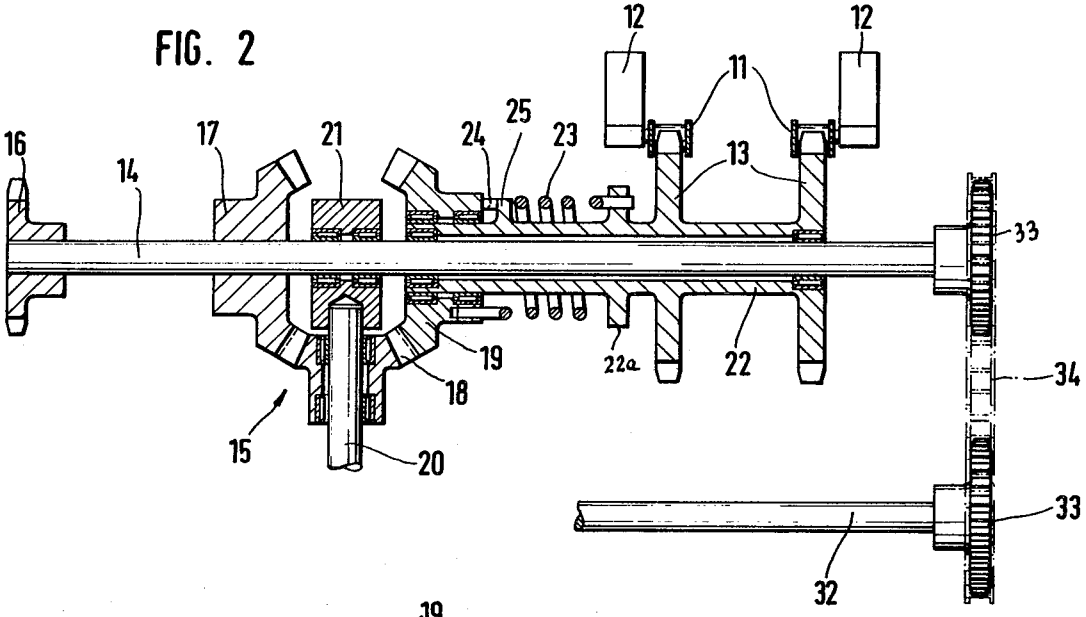
FIG. 2 is an enlarged sectional view substantially as seen in the direction of arrows from the line II—II of FIG. 1.
Figure 3:
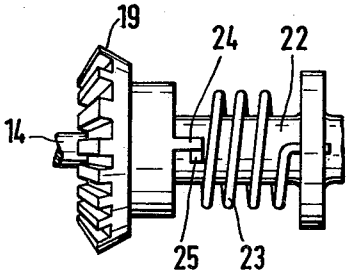
FIG. 3 is an elevational view of a detail in the structure of FIG. 2.

The machine further comprises a second conveyor 6 having a plurality of equally spaced entraining members or pushers 12 affixed to two endless transporting chains 11 or analogous flexible elements. As shown in FIG. 2, each pusher comprises two aligned sections or halves with one section affixed to one of the chains 11 and the other section affixed to the other chain 11. The chains 11 are trained around a pair of front sprocket wheels 13 and a pair of rear sprocket wheels 13*a* so that their upper reaches define an elongated straight horizontal portion of an endless path for the pushers 12. Such horizontal portion of the path for the pushers 12 is adjacent to and located below the illustrated horizontal portion of the path for the grippers 1. The arrangement is such that when a pusher 12 moves around the front sprocket wheels 13 and advances in the direction indicated by arrow P2, it is located between a pair of neighboring grippers 1 and cooperates with the preceding gripper, i.e., with the gripper which is located ahead as considered in the direction indicated by arrow P1 or P2.

Figure 4:
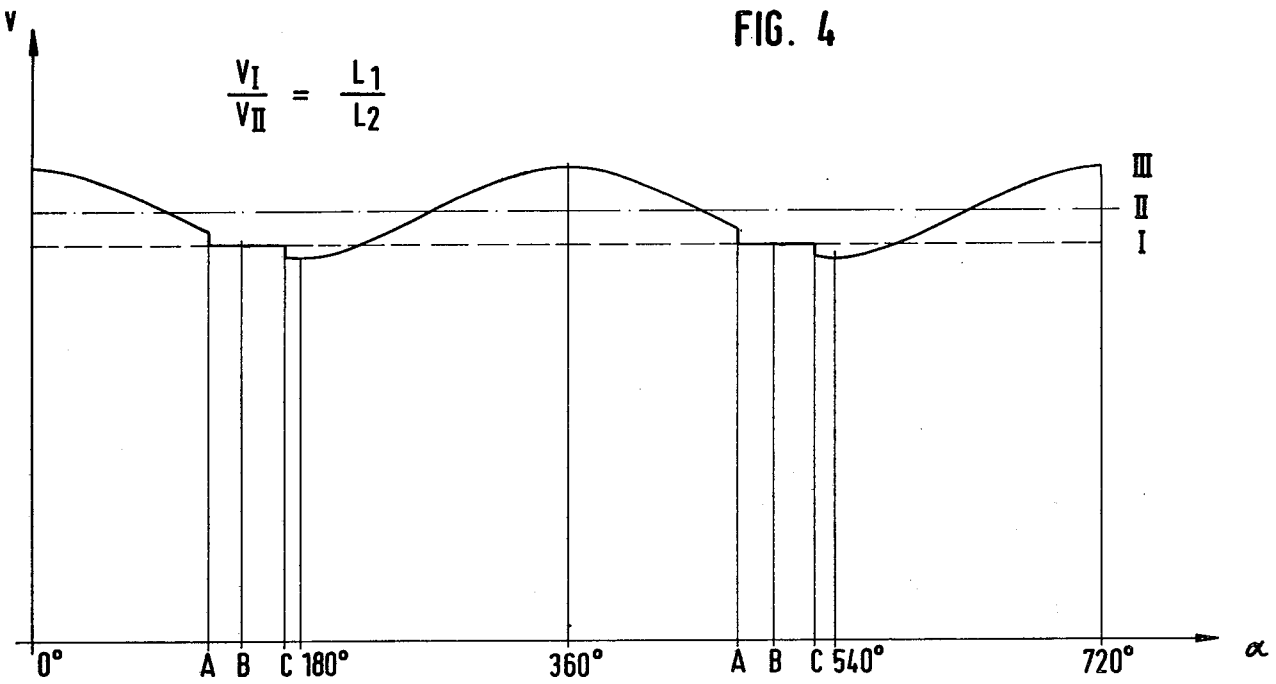
FIG. 4 is a diagram showing the relationship between the speeds of a gripper and the associated pusher prior to, during and subsequent to transfer of a sheet.

One of the sprocket wheels for the chain 2 drives the grippers 1 at a constant first speed indicated by the broken line I shown in the coordinate system of FIG. 4. The drive means for the chains 11 and their pushers 12 comprises two units the first of which can drive the pushers at a second constant speed (see the phantom line II of FIG. 4) and the second of which serves to change such second speed during certain stages of movement of pushers with the upper reaches of the chains 11. The actual speed of the pushers 12 is indicated by the solid-line curve III of FIG. 4.

The first unit (see FIG. 2) of drive means for the chains 11 of the conveyor 6 comprises a shaft 14 which is coaxial with the front sprocket wheels 13 and is rigid with a sprocket wheel 16 which receives torque from the main prime mover of the bookbinding machine through the medium of an endless chain, not shown. The shaft 14 is further rigid with a first side gear 17 which is in mesh with a pinion 18 rotatable on a swingable shaft 20. One end of the shaft 20 extends beyond the pinion 18 toward the shaft 14 and is received in a bearing 21 which is rotatable on the shaft 14 between the side gear 17 and a second side gear 19 which meshes with the pinion 18 and is rotatable at one end of a hollow shaft 22 rigid with the sprocket wheels 13 and surrounding an intermediate portion of the shaft 14. The pinion 18 and the side gears 17, 19 constitute component parts of a transmission 15 which resembles a simple differential.

The means for transmitting torque from the side gear 19 to the hollow shaft 22 for the sprocket wheels 13 comprises a first projection 24 which extends from the side gear 19 in parallelism with the axis of the shaft 14 and a second projection 25 which extends radially from the shaft 22 and is normally engaged by the projection 24. The first unit of the drive means for the chains 11 further comprises a torsion spring 23 which surrounds the hollow shaft 22 between the left-hand sprocket wheel 13 (as viewed in FIG. 2) and the side gear 19. One end of the torsion spring 23 is anchored in a collar **22*a* of the shaft 22 and the other end of this spring is anchored in the side gear 19**.

The second unit of drive means for the chains 11 comprises a face cam 31 which is mounted on a camshaft 32 receiving torque from the shaft 14 through the medium of two sprocket wheels 33 and an endless chain 34. The cam 31 has an endless groove 30 for the follower 29 of a lever 27 which is pivotably secured to the frame F of the bookbinding machine by a pin 28. The free end of the lever 27 is articulately connected with one end of a link 26 articulately connected to that end of the shaft 20 for the pinion 18 which is remote from the shaft 14. When the cam 31 rotates, its groove 30 causes the follower 29 to pivot the lever 27 which causes the link 26 to swing the shaft 20 and to thereby roll the pinion 18 with respect to the side gears 17 and 19. Since the gear 17 is driven at a constant speed (see the line II in FIG. 4), such swinging movement of the shaft 20 changes the speed of the side gear 19 and sprocket wheels 13 for the chains 11.

The structure of FIG. 1 further comprises a feeding mechanism 5 which delivers discrete sheets 4 into the path of movement of successive pushers 12 before such pushers move to the apices of sprocket wheels 13. The pushers 12 thereupon entrain the respective sheets 4 along the upper reaches of the chains 11 and below the adhesive-coated lower edge faces **3*a* of groups 3 which are held by the preceding grippers 1. The mechanism 5 comprises a magazine or tray 7 for a stack 10 of superimposed sheets 4 and a pivotable suction head 8 which lifts successive uppermost sheets 4 of the stack 10 and introduces the leaders of such sheets into the nip of two driven advancing rolls 9. The rolls 9 are located ahead of the upper reaches of the chains 11** and are rotated in the directions indicated by arrows.

The bookbinding machine further comprises means for transferring sheets 4 from the upper reaches of the chains 11 into contact with the adhesive-coated lower edge faces **3*a* of groups 3 in the adjacent grippers 1. The transferring means including a single pressing member 35 which is articulately connected to two links 35*a* rotated by driven wheels 35*b*. The pressing member 35 is installed in the space between the chains 11 and performs a composite movement including a movement in the direction indicated by arrow P1 at a time when it rises from the level of the upper reaches of the chains 11 toward the lower edge face 3*a* of the adjacent group 3. This results in the transfer of a sheet 4 into contact with the film of adhesive on such edge face 3*a*. At the time, the pressing member 35 transfers a sheet 4 into contact with the respective group 3, the corresponding pusher 12 abuts against the gripper 1 to thus insure that the sheet 4 is accurately oriented with respect to the group 3** thereabove.

FIG. 1 further shows the distance L1 which a gripper 1 must cover during movement along the elongated portion of the path defined by the conveyor including the chain 2 while the associated pusher 12 must cover a longer distance L2 in order to insure that the pusher abuts against the rear end of the preceding gripper when the pressing member 35 is caused to transfer a sheet 4 against the edge face **3*a* of the adjacent group 3**.

The sheets 4 are preferably large enough to overlie both exposed sides of a group 3 when their outer portions are folded over the respective outer sides while the central portion of the sheet adheres to the adhesive-coated edge face **3*a* of the group 3. Proper orientation and centering of a sheet 4 is insured if the transfer of the sheet into contact with the respective group 3 takes place while the pusher 12 which advances the sheet abuts against the preceding gripper 1. The manner in which at least one of the advancing rolls 9 is driven by the main prime mover of the bookbinding machine in synchronism with the movement of pushers 12 is not shown in the drawing. The torsion spring 23 is installed in prestressed condition so that it normally maintains the projection 25 in engagement with the projection 24. When the speed of the sprocket wheels 13 decreases because the pushers 12 encounter a greater resistance to forward movement, the projection 25 lags behind the projection 24 and the torsion spring 23 stores additional energy. The side gear 19 then transmits torque to the shaft 22 through the medium of the spring 23**.

In the coordinate system of FIG. 4, the angular displacement (alpha) of the cam 31 is measured along the abscissa and the speed (V) of the grippers 1 and pushers 12 is measured along the ordinate. The ratio $V_I$ to $V_{II}$ (speed of a gripper to speed of a pusher) equals the ratio $L_1$ to $L_2$.

The operation:

When the prime mover of a bookbinding machine is on, the shaft 14 drives the camshaft 32 at a constant speed and transmits torque to the sprocket wheels 13 through the medium of the transmission 15 and the projections 24, 25. The main prime mover further drives one sprocket wheel for the chain 2 and at least one advancing roll 9. Furthermore, the main prime mover imparts movements to the suction head 8 so that the latter delivers successive discrete sheets 4 into the nip of the advancing rolls 9.

As the cam 31 rotates with the shaft 32, the surfaces bounding its groove 30 cause the follower 29 to pivot the lever 27 back and forth through predetermined angles and in predetermined angular positions of the cam 31 (see FIG. 4). This causes the link 26 to swing the pinion 18 back and forth about the axis of the shaft 14 and to thereby accelerate or decelerate the side gear 19 and shaft 22 for the sprocket wheels 13. In the absence of any swinging movements of the shaft 20 for the pinion 18, the pushers 12 travel at the speed II which exceeds the speed I of the grippers 1. The speed II would suffice to insure that a trailing pusher 12 catches up with the preceding gripper 1 during movement with the upper reaches of the chains 11 before the sheet 4 which is advanced by such pusher moves into the range of the pressing member 35. Minor deviations of the speed II from an optimum speed are of no consequence because, if the speed II is a little higher than necessary, the pusher 12 simply bears against the preceding gripper 1 and is thereby decelerated whereby the torsion spring 23 stores additional energy. The difference between the speed $V_I$ of grippers 1 and the speed $V_{II}$ of the pushers 12 can be altered by changing the angular position of the cam 31 with respect to the camshaft 32. As a rule, the difference between the speeds $V_I$ and $V_{II}$ will be relatively small to insure a more reliable orientation of sheets 4 relative to the adjacent groups 3 before the sheets move into the range of the pressing member 35.

While a pusher 12 covers the distance from A to C (see FIGS. 1 and 4), the pressing plate 35 moves upwardly and engages the sheet 4 not later than when the pusher reaches the position C. The curve III of FIG. 4 indicates that a pusher 12 which advances a sheet 4 is accelerated while the cam 31 rotates through an angle alpha of 180 degrees and is thereupon decelerated to engage the preceding gripper 1 in the position A. The speed of the pusher 12 then matches the speed (I) of the gripper 1 during movement between A and C (through an intermediate position B) whereupon the speed of the pusher decreases below the speed I to allow the preceding gripper 1 to move ahead of such pusher. This insures that the grippers 1 do not interfere with movements of pushers 12 and vice versa while the grippers move away from the straight horizontal portion of their path and while the pushers 12 move around the rear sprocket wheels 13*a*. The pushers are then accelerated again so that their speed exceeds the speeds I and II. The torsion spring 23 stores additional energy between the positions A and B and dissipates energy between the positions B and C. The pressing plate 35 transfers the sheet from the space in front of a pusher 12 into contact with the group 3 thereabove while the pusher moves with the preceding gripper (i.e., while the pusher moves between A and C).

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution of the art and, therefore, such adaptations should and are intended to be comprehended within the meaning and range of equivalence of the appended claims.

What is claimed is:

1. In a bookbinding machine wherein sheets of paper or the like are attached to adhesive-coated edge faces of groups or leaves, a combination comprising a first conveyor having a plurality of equally spaced grippers for said groups and means for transporting said grippers at a constant first speed along a first endless path having an elongated portion along which said grippers move in a predetermined direction; a second conveyor having a plurality of equally spaced pushers and means for transporting said pushers along a second endless path having an elongated portion which is adjacent and substantially parallel to said portion of said first path and along which said pushers move in said direction and alternate with said grippers so that each gripper which moves along said portion of said first path preceeds a pusher in said portion of said second path; a source of sheets; means for feeding discrete sheets from said source in front of successive pushers which enter said portion of said second path whereby the oncoming pushers entrain the respective sheets and advance such sheets along said portion of said second path in substantial register with the edge faces of groups in the preceding grippers; drive means for said transporting means of said second conveyor, including a first unit having means for moving said last mentioned transporting means at a substantially constant second speed exceeding said first speed and a second unit having means for changing the speed of said last mentioned transporting means during a plurality of predetermined stages of movement of said pushers along said portion of said second path; and means for transferring sheets from said portion of said second path into contact with the adhesive-coated edge faces of groups in the preceding grippers during a selected stage of movement of the respective pushers along said portion of said second path.

2. A combination as defined in claim 1, wherein said portions of said paths are substantially horizontal.

3. A combination as defined in claim 2, wherein said portion of said first path is located at a first level and said portion of said second path is located at a different second level.

4. A combination as defined in claim 1, wherein said portions of said paths are straight.

5. A combination as defined in claim 1, wherein said means for changing the speed of said transporting means of said second conveyor includes means for increasing the speed of said pushers above said second speed during at least one first stage of said plurality of stages and for reducing the speed of said pushers below said first speed during at least one second stage of said plurality of stages of movement of said pushers along said portion of said second path.

6. A combination as defined in claim 1, wherein the transporting means of at least one of said conveyors includes at least one endless chain.

7. A combination as defined in claim 1, wherein said transporting means of said second conveyor includes two endless flexible elements having parallel stretches which define said portion of said second path, each of said pushers being attached to both said flexible elements.

8. In a book-binding machine wherein sheets of paper or the like are attached to adhesive-coated edge faces of groups of leaves, a combination comprising a first conveyor having a plurality of equally spaced grippers for said groups and means for transporting said grippers at a first speed along a first endless path having an elongated portion along which said grippers move in a predetermined direction; a second conveyor having a plurality of equally spaced pushers and means for transporting said pushers along a second endless path having an elongated portion which is adjacent and substantially parallel to said portion of said first path and along which said pushers move in said direction and alternate with said grippers so that each gripper which moves along said portion of said first path precedes a pusher in said portion of said second path; a source of sheets; means for feeding discrete sheets from said source in front of successive pushers which enter said portion of said second path whereby the oncoming pushers entrain the respective sheets and advance such sheets along said portion of said second path in substantial register with the edge faces of groups in the preceding grippers; drive means for said transporting means of said second conveyor, including a first unit having means for moving said last mentioned transporting means at a substantially constant second speed and a second unit having means for changing the speed of said last mentioned transporting means during a plurality of predetermined stages of movement of said pushers along said portion of said second path, said means for changing the speed of said transporting means of said second conveyor including means for reducing the speed of said last mentioned transporting means below said first speed during at least one of said stages; means for yieldably opposing such reduction of speed of said last mentioned transporting means and said pushers; and means for transferring sheets from said portion of said second path into contact with the adhesive-coated edge faces of groups in the preceding grippers during a selected stage of movement of the respective pushers along said portion of said second path.

9. In a bookbinding machine wherein sheets of paper or the like are attached to adhesive-coated edge faces of groups of leaves, a combination comprising a first conveyor having a plurality of equally spaced grippers for said groups and means for transporting said grippers at a first speed along a first endless path having an elongated portion along which said grippers move in a predetermined direction; a second conveyor having a plurality of equally spaced pushers and means for transporting said pushers along a second endless path having an elongated portion which is adjacent and substantially parallel to said portion of said first path and along which said pushers move in said direction and alternate with said grippers so that each gripper which moves along said portion of said first path precedes a pusher in said portion of said second path; a source of sheets; means for feeding discrete sheets from said source in front of successive pushers which enter said portion of said second path whereby the oncoming pushers entrain the respective sheets and advance such sheets along said portion of said second path in substantial register with the edge faces of groups in the preceding grippers; drive means for said transporting means of said second conveyor, including a first unit having means for moving said last mentioned transporting means at a substantially constant second speed and a second unit having means for changing the speed of said last mentioned transporting means during a plurality of predetermined stages of movement of said pushers along said portion of said second path, said second speed exceeding said first speed so that each pusher which moves along said portion of said second path temporarily catches up with and engages the preceding gripper; and means for transferring sheets from said portion of said second path into contact with the adhesive-coated edge faces of groups in the preceding grippers during a selected stage of movement of the respective pushers along said portion of said second path, said selected stage being that stage during which a pusher engages the preceding gripper.

10. A combination as defined in claim 9, wherein said plurality of stages include a further stage which follows said selected stage and during which said second unit of said drive means reduces the speed of said pushers to below said first speed so that the preceding grippers move forwardly of and away from the respective pushers.

11. In a bookbinding machine wherein sheets of paper or the like are attached to adhesive-coated edge faces of groups of leaves, a combination comprising a first conveyor having a plurality of equally spaced grippers for said groups and means for transporting said grippers at a first speed along a first endless path having an elongated portion along which said grippers move in a predetermined direction; a second conveyor having a plurality of equally spaced pushers and means for transporting said pushers along a second endless path having an elongated portion which is adjacent and substantially parallel to said portion of said first path and along which said pushers move in said direction and alternate with said grippers so that each gripper which moves along said portion of said first path precedes a pusher in said portion of said second path; a source of sheets; means for feeding discrete sheets from said source in front of successive pushers which enter said portion of said second path whereby the oncoming pushers entrain the respective sheets and advance such sheets along said portion of said second path in substantial register with the edge faces of groups in the preceding grippers; drive means for said transporting means of said second conveyor, including a first unit having means for moving said last mentioned transporting means at a substantially constant second speed and a second unit having means for changing the speed of said last mentioned transporting means during a plurality of predetermined stages of movement of said pushers along said portion of said second path, said first unit comprising a driven shaft, a transmission including a first side gear rigid with said shaft, a second side gear coaxial with said first side gear and a pinion in mesh with said side gears, a rotary member which drives said transporting means of said second conveyor, and means for transmitting torque from said second side gear to said rotary member; and means for transferring sheets from said portion of said second path into contact with the adhesive-coated edge faces of groups in the preceding grippers during a selected stage of movement of the respective pushers along said portion of said second path.

12. A combination as defined in claim 11, wherein said second unit comprises means for moving said pinion about the axis of said shaft to thereby change the speed of said second side gear.

13. A combination as defined in claim 12, wherein said means for moving said pinion comprises a second shaft rotatably supporting said pinion and extending substantially radially of said driven shaft and means for swinging said second shaft back and forth about the axis of said driven shaft.

14. A combination as defined in claim 13, wherein said means for swinging comprises a rotary cam, follower means tracking said cam and means for operatively connecting said follower means with said second shaft.

* * * * *